US008323419B2

(12) United States Patent
Bastigkeit et al.

(10) Patent No.: US 8,323,419 B2
(45) Date of Patent: Dec. 4, 2012

(54) METHOD FOR CONTROLLING A METERING DEVICE ARRANGED MOVABLY ON THE INSIDE OF A DISHWASHER

(75) Inventors: Thorsten Bastigkeit, Wuppertal (DE); Salvatore Fileccia, Oberhausen (DE); Arnd Kessler, Monheim am Rhein (DE); Christian Nitsch, Düsseldorf (DE); Heinz-Dieter Eichholz, Iserlohn (DE); Gerold Jans, Waldburg (DE); Roland Schmalz, Waldburg (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/433,763

(22) Filed: Mar. 29, 2012

(65) Prior Publication Data

US 2012/0222712 A1 Sep. 6, 2012

Related U.S. Application Data

(63) Continuation of application No. PCT/EP2010/064553, filed on Sep. 30, 2010.

(30) Foreign Application Priority Data

Sep. 30, 2009 (DE) ..... 10 2009 045 192

(51) Int. Cl.
*B08B 7/00* (2006.01)

(52) U.S. Cl. ..... 134/25.2; 134/42; 134/18; 222/1; 222/52

(58) Field of Classification Search ..... None
See application file for complete search history.

(56) References Cited

U.S. PATENT DOCUMENTS

2002/0088502 A1* 7/2002 Van Rompuy et al. ..... 141/1

FOREIGN PATENT DOCUMENTS

DE 102006043973 A1 3/2008
WO WO 2010/007045 A1 1/2010

OTHER PUBLICATIONS

PCT International Search Report (PCT/EP2010/064553) dated Feb. 24, 2011.

* cited by examiner

*Primary Examiner* — Michael Kornakov
*Assistant Examiner* — Nicole Blan
(74) *Attorney, Agent, or Firm* — David K. Benson

(57) ABSTRACT

The present invention is a method for controlling a dispenser reversibly positioned in a dishwasher. The dispenser or dishwasher is configured with light transmission and receiving units. Light pulses are transmitted into the interior of the dishwasher and received by the receiving unit. The time difference ($t_{r2}-t_{r1}$) between the pulses is determined and that time difference is used to encode an information item or a portion of an information item. Such information items include a control signal, a measured value, an operating state of the automatic dishwasher and/or of the dispensing apparatus.

20 Claims, 5 Drawing Sheets

METHOD FOR CONTROLLING A METERING DEVICE ARRANGED MOVABLY ON THE INSIDE OF A DISHWASHER

CROSS-REFERENCE TO RELATED APPLICATIONS

This application is a continuation of PCT Application Serial No. PCT/EP2010/064553, filed on Sep. 30, 2010, which claims priority under 35 U.S.C. §119 to 10 2009 045 192.7 (DE) filed on Sep. 30, 2009. The disclosures PCT/EP2010/064553 and DE 10 2009 045 192.7 are hereby incorporated by reference in their entirety.

FIELD OF THE INVENTION

The present invention generally relates to a method for controlling dispensing apparatus arranged in the interior of an automatic dishwasher, and more particularly relates to a method for wireless transfer of information items in the interior of an automatic dishwasher.

BACKGROUND OF THE INVENTION

Dishwashing agents are available to consumers in a large number of presentation forms. In addition to the traditional liquid hand dishwashing agents, automatic dishwashing agents have particular significance now that household automatic dishwashers are widespread. These automatic dishwashing agents are offered to the consumer typically in solid form, for example as powders or tablets, but increasingly also in liquid form. Emphasis has for some time been placed principally on convenient dispensing of washing and cleaning agents, and on simplification of the working steps necessary for carrying out a washing or cleaning method.

Furthermore, one of the main objectives of manufacturers of automatic cleaning agents is to improve the cleaning performance of these agents, increased attention recently having been paid to cleaning performance in cleaning cycles consisting of low-temperature and/or reduced water consumption. To this end, new ingredients, for example more-effective surfactants, polymers, enzymes or bleaching agents, have been added to the cleaning agents. Because new ingredients are available only to a limited extent, however, and because for environmental and economic reasons the quantity of the ingredients used per cleaning cycle cannot be arbitrarily increased, there are natural limits to this approach to a solution.

In this connection, apparatuses for multiple dispensing of dishwashing and cleaning agents have very recently come under scrutiny by product developers. With regard to these apparatuses, a distinction may be made between on the one hand dispensing chambers integrated into the automatic dishwasher, and on the other hand separate devices independent of the automatic dishwasher. By means of these apparatuses, which contain several times the quantity of cleaning agent required to carry out a cleaning method, washing- or cleaning-agent portions are automatically or semi-automatically dispensed into the interior of an automatic dishwasher in the course of multiple successive cleaning processes. For the consumer, the need for manual dispensing for each cleaning or dishwashing cycle is eliminated. Examples of such apparatuses are described in European patent application EP 1 759 624 A2 (Reckitt Benckiser) or in German patent application DE 53 5005 062 479 A1 (BSH Bosch and Siemens Hausgeräte GmbH).

It would be advantageous in this connection to have available a method for transmitting information items between an automatic dishwasher and a dispenser arranged in the automatic dishwasher, with the result that cleaning-agent delivery from such dispensers would be capable of further optimization, for example by way of an exact coordination with the washing programs executing in the dishwasher.

The object of the invention is therefore to make available an economical and reliable method for wireless transmission of information items between a dispensing apparatus movably arranged in the interior of an automatic dishwasher and an automatic dishwasher. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

This object is achieved by a method for controlling a dispensing apparatus movably arranged in the interior of an automatic dishwasher, encompassing the following method steps: a first light pulse $I_1$ is emitted from a transmitting unit, with a predefined pulse duration $l_{t1}$, into the interior of the automatic dishwasher; the first light pulse $I_1$ is received by a receiving unit in the interior of the automatic dishwasher and a time measurement is started upon reception of the light pulse $I_1$ at point in time $t_{I1}$; a second light pulse $I_2$ is emitted from the transmitting unit, with a predefined pulse duration $l_{t1}$, into the interior of the automatic dishwasher; the second light pulse $I_2$ is received by the receiving unit in the interior of the automatic dishwasher and, upon reception of the light pulse $I_2$ at point in time $t_{I2}$, the time difference $(t_{I2}-t_{I1})$ between reception of the second light pulse $I_2$ and of the first light pulse $I_1$ is determined, the time difference $(t_{I2}-t_{I1})$ encoding an information item or a portion of an information item, for example in particular a control signal, a measured value, an operating state of the automatic dishwasher and/or of the dispensing apparatus.

The advantage of the method is that it ensures reliable and sufficiently rapid transfer of information items for operating of a dispensing apparatus in the interior of an automatic dishwasher, which can be effected by the use of a small number of robust and inexpensive components.

BRIEF DESCRIPTION OF THE DRAWING FIGURES

DETAILED DESCRIPTION OF THE INVENTION

Figure 1:
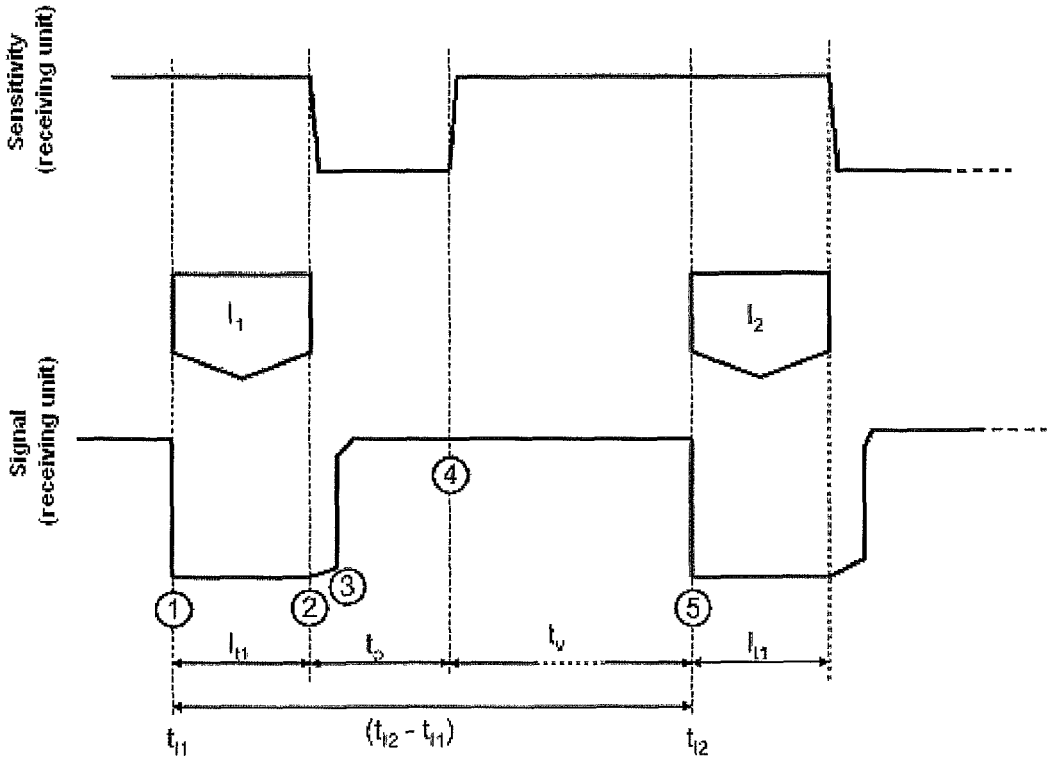
FIG. 1 illustrates the signal and sensitivity curves at the receiving unit.

The following detailed description of the invention is merely exemplary in nature and is not intended to limit the invention or the application and uses of the invention. Furthermore, there is no intention to be bound by any theory presented in the preceding background of the invention or the following detailed description of the invention.

In an advantageous embodiment of the method, a light pulse having a predefined pulse duration $l_{t1}$ is followed by a predefined fixed transmission off-time $t_p$, followed by a variable transmission off-time $t_v$, the variable transmission off-time $t_v$ encoding an information item. The fixed transmission off-time is selected in particular so that the idle level of the receiving unit is reliably reached again after reception of the light pulse. To ensure a sufficiently rapid transfer, it is particularly advantageous that the fixed transmission off-time $t_p$ be shorter than the shortest variable transmission off-time $t_v$.

It is preferable that the wavelength of the light pulse be selected from the visible spectrum between 380 and 780 nm. Alternatively, the wavelength of the light pulse can be selected from the near infrared region (780 nm to 3000 nm) or the middle infrared region (3.0 μm to 50 μm) or the far infrared region (50 μm to 1 mm).

In order to ensure reliable reception of a light pulse simultaneously with a sufficient transfer rate, the pulse duration $l_{t1}$ of the light pulse is selected preferably between 1 and 100 ms, particularly preferably between 4 and 50 ms, very particularly preferably between 10 and 25 ms.

In order to provide a workable information transfer rate simultaneously with good transfer reliability, the predefined fixed transmission off-time $t_p$ is selected preferably between 1 and 100 ms, particularly preferably between 4 and 50 ms, very particularly preferably between 10 and 25 ms. In a particularly preferred embodiment of the invention, the predefined fixed off-time $t_p$ corresponds approximately to the pulse duration $l_{t1}$ of a light pulse.

The variable transmission off-time $t_v$ is selected preferably between 1 and 1000 ms, particularly preferably between 5 and 500 ms, very particularly preferably between 10 and 250 ms, with the result that once again a workable information transfer rate can be made available simultaneously with good transfer reliability.

In the context of complex information items that are made up of a plurality of parameters, it is preferable that an information item of this kind be encoded from a sequence of light pulses. It is advantageous in principle that information items to be transferred often are encoded with a pulse sequence that is as short as possible or with time difference ($t_{I2}-t_{I1}$) that is as short as possible, in order to maximize the transfer speed of the method according to the present invention; while information items to be transferred more seldom are encoded with longer pulse sequences or with a longer time difference ($t_{I2}-t_{I1}$).

It furthermore proves useful that the emitted light pulse signal is intrinsically modulated, in order to enable intrinsic signal detection and thus reduce susceptibility to interference signals or external signals. The light pulse signal is preferably modulated as a burst signal; with corresponding use of a band filter, e.g. a bandpass, within the receiving unit, this allows reliable intrinsic signal detection. The fault susceptibility of the control method being described is thereby considerably decreased.

In order further to improve the transfer rate of the method according to the present invention, it is preferable that the sensitivity of the receiving unit is adjustable. It is particularly advantageous that the sensitivity of the receiving unit is adjustable between a high sensitivity and a low sensitivity.

It is particularly preferred in this context that the receiving unit is set to a high sensitivity upon reception of a light pulse, so that light pulses can be detected quickly and reliably. It is further advantageous if the receiving unit be set to a low sensitivity immediately after reception of a light pulse having a predefined pulse duration $l_{t1}$. The result is that the receiving unit returns more quickly to its idle level, and is thus more quickly ready again to detect a subsequent light pulse.

Switchover of the sensitivity of the receiving unit can occur in particular by means of a suitable dropping resistance.

A "low sensitivity" for purposes of this application is understood as a sensitivity of the receiving unit at which, in a dark room having black walls and encapsulated from ambient light, with a distance of 20 cm between the transmitting and receiving units and a light pulse with a duration of 15 milliseconds at an illumination intensity of at least 150 lux for the signal emitted at the receiving unit, a signal can still be detected, the wavelength regions of the transmitting and receiving units being coordinated with one another and being located in the visible spectrum between 380 and 780 nm.

A "high sensitivity" for purposes of this application is understood as a sensitivity of the receiving unit at which, in a dark room having black walls and encapsulated from ambient light, with a distance of 20 cm between the transmitting and receiving units and a light pulse with a duration of 15 milliseconds at an illumination intensity of less than 150 lux for the signal emitted at the receiving unit, a signal can still be detected, the wavelength regions of the transmitting and receiving units being coordinated with one another and being located in the visible spectrum between 380 and 780 nm.

In order to increase the sensitivity of the receiving unit again prior to reception of a light pulse, with no delaying influence in terms of achieving the idle level, it is advantageous for the receiving unit to be set to a high sensitivity immediately after the predefined fixed transmission off-time $t_p$.

In a preferred embodiment of the invention, the receiving unit encompasses at least one photodiode. In a further preferred embodiment, the transmitting unit encompasses at least one LED and/or at least one laser diode.

It is particularly preferable for the dispenser to possess a receiving unit and/or a transmitting unit for the reception and emission, respectively, of light pulses. It is further preferred that the automatic dishwasher possess a receiving unit and/or a transmitting unit.

In a particularly preferred embodiment of the invention, the receiving unit and/or transmitting unit is/are provided in a combination dispenser preferably arranged in the automatic dishwasher door.

Information items can be transferred by means of the method according to the present invention in particular from the dispenser to the automatic dishwasher and/or from the automatic dishwasher to the dispenser.

Coding

In order to bring about on the part of the automatic dishwasher or the automatic dishwasher control system a delivery of an active-substance preparation from the dispenser, it is advantageous that at least one time difference ($t_{I2}-t_{I1}$) between two light pulses be coded in such a way that upon reception of the light pulses by the receiving unit, the delivery of at least one first preparation from the dispenser into the automatic dishwasher is effected.

In order to check whether a dispenser is present in the interior of an automatic dishwasher, it is advantageous to configure the method according to the present invention in such a way that at least one time difference ($t_{I2}-t_{I1}$) between two light pulses is encoded in such a way that upon reception of the light pulses by the dispenser-side receiving unit, the emission of a signal from the dispenser to the automatic dishwasher is effected, the signal encompassing at least the information item as to the presence of the dispenser in the interior of the automatic dishwasher.

The time difference ($t_{I2}-t_{I1}$) between two light pulses can furthermore be encoded in such a way that they represent information items of the dispenser, for example operating duration, fill level of the cartridge or of the individual cartridge chambers, battery charge status, number of dispensing operations, number of cleaning cycles completed, detection of washing arm rotation blockage, software version of the control unit, temperature measured by the dispenser in the interior of the dishwasher, resistance values measured by the dispenser at the conductivity sensor.

The time difference ($t_{I2}-t_{I1}$) between two light pulses can furthermore also be encoded in particular in such a way that they represent information items of the dishwasher, for example the automatic dishwasher manufacturer, dishwasher model, nature and/or progress of a washing program internal to the machine, control instructions for opening and/or closing valves and/or switching on and/or off pumps in the dispenser.

The coding can be executed as hexadecimal coding or digital coding. Hexadecimal coding is appropriate in particular for smaller volumes of data or information items to be transferred. A digital coding (0/1) may be advantageous for larger volumes of data and/or information.

Lastly, the information item to be transferred within the light pulse signal can advantageously be encoded, in addition to the time difference ($t_{I2}-t_{I1}$), also by way of the variable transmission off-time $t_v$, the configuration of the light pulse sequence, or the embodiment of the light pulse signal modulation.

Dispenser

The control unit necessary for operation, and at least one actuator by which the delivery of preparation into the interior of the dishwasher is affected, are integrated into the dispenser that is positionable in the interior of a dishwasher. A sensor unit, in particular a temperature and/or conductivity sensor, and/or an energy source, is preferably likewise arranged on or in the dispenser.

It is particularly preferred that the dispenser encompass at least one first interface that interacts with a corresponding interface embodied in or on a household appliance, in particular a water-conveying household appliance, preferably an automatic dishwasher or washing machine, in such a way that a transfer of electrical energy and/or signals from the household appliance to the dispenser, and/or from the dispenser to the household appliance, is effected.

The interfaces are embodied in particular in such a way that a wireless transfer of electrical energy and/or electrical and/or optical signals is affected.

It is particularly preferred in this context that the interfaces provided for the transfer of electrical energy be inductive transmitters and/or receivers of electromagnetic waves. In particular, for example, the interface of a water-conveying appliance, such as e.g. an automatic dishwasher, can be embodied as a transmitter coil having an iron core and operated with alternating current, and the interface of the dispenser as a receiver coil having an iron core.

In an alternative embodiment, the transfer of electrical energy can also be provided by means of an interface which comprises on the household-appliance side an electrically operated light source and, on the dispenser side, a light sensor, for example a photodiode or a solar cell. The light emitted by the light source is converted by the light sensor into electrical energy, which is then in turn stored, for example, by a storage battery on the dispenser side.

In an advantageous refinement of the invention, an interface is provided on the dispenser and on the water-conveying household appliance, such as for instance an automatic dishwasher, for transferring (i.e. transmitting and receiving) electromagnetic and/or optical signals that in particular represent operating state, measurement and/or control information items of the dispenser and/or of the water-conveying appliance such as an automatic dishwasher.

It is of course possible to provide only a single common interface that is suitable for making available a transfer both of electrical energy and of signals, or a respective interface for transferring signals and a separate further interface for transferring electrical energy.

Such an interface can in particular be embodied such that a wireless transfer of electrical energy and/or electromagnetic and/or optical signals is affected.

It is particularly preferred that the interface be configured for emitting and/or receiving optical signals. It is very particularly preferred that the interface be configured to emit and/or receive light in the visible region. Since darkness usually prevails in the interior of the washing space during operation of an automatic dishwasher, signals can be emitted and/or detected by the dispenser in the visible optical range, for example in the form of signal pulses and/or light flashes. It has proven particularly advantageous in this context to use wavelengths between 600 and 800 nm in the visible spectrum.

Alternatively or additionally, it is advantageous for the interface to be configured for the emission and/or reception of infrared signals. It is advantageous in particular for the interface to be configured for the emission and/or reception of infrared signals in the near infrared region (780 nm to 3000 nm).

The interface encompasses in particular at least one LED. Particularly preferably, the interface encompasses at least two LEDs. It is also possible, according to a further preferable embodiment of the invention, to provide at least two LEDs that emit light at wavelengths differing from one another. This makes it possible, for example, to define different signal bands on which information items can be sent and/or received.

It is further advantageous, in a refinement of the invention, for at least one LED to be an RGB LED whose wavelength is adjustable. It is thus possible, for example, to define with one LED a variety of signal bands that emit signals at different wavelengths. It thus also conceivable, for example, for light to be emitted during the drying operation, during which high humidity (mist) is present in the washing space, at a different wavelength than, for example, during a washing step.

The interface of the dispenser can be configured so that the LED is provided both for the emission of signals into the interior of the dishwasher, in particular when the automatic dishwasher door is closed, and for optical indication of an operating state of the dispenser, in particular when the automatic dishwasher door is open.

It is further advantageous that the interface of the dispenser be configured in such a way that it emits an optical signal, when the automatic dishwasher is closed and unloaded, that produces an average illumination intensity E of between 0.01 and 100 lux, preferably between 0.1 and 50 lux, measured at the walls delimiting the washing space. This illumination intensity is then sufficient to produce multiple reflections with and/or at other washing space walls, thereby reducing and/or preventing signal shadows in the washing space, especially when the automatic dishwasher is in the loaded state.

The signal emitted and/or received by the interface is in particular a carrier of information, in particular a control signal or a signal that represents an operating state of the dispenser and/or of the automatic dishwasher.

In an advantageous refinement of the invention, the dispenser for delivering at least one washing- and/or cleaning-agent preparation from a cartridge into the interior of a household appliance comprises a light source by means of which a light signal can be coupled into a light guide of the cartridge. The light source can in particular be an LED. It is thereby possible, for example, to in-couple light signals that for example represent the operating state of the dispenser, from the dispenser into the cartridge, so that they are visually perceptible at the cartridge by a user. This is advantageous in particular because, in the utilization position in the plate receptacle of a tableware rack in a dishwasher, the dispenser may be visually concealed between other items to be washed. By in-coupling light from the dispenser into the cartridge, the corresponding light signals can for example also be guided into the top region of the cartridge so that, even if the dispenser is positioned in the plate receptacle between other items to be washed, the light signals are visually perceptible by the user since, if the tableware rack is properly loaded, the top zones of the items to be washed and of the cartridge usually remain uncovered.

It is furthermore possible for the light signal coupled into and passing through the light guide of the cartridge to be detectable by a sensor located on the dispenser. This is explained in greater detail in a subsequent section.

In a further, advantageous embodiment, the dispenser for delivering at least one washing- and/or cleaning-agent preparation into the interior of a household appliance encompasses at least one optical transmitting unit, the optical transmitting unit being configured in such a way that signals from the transmitting unit are couplable into a cartridge couplable to the dispenser, and signals from the transmitting unit can be radiated into the environment of the dispenser. It is thereby possible to realize, by means of one optical transmitting unit, both signal transmission between the dispenser and, for example, a household appliance such as an automatic dishwasher, and signal input into a cartridge.

The optical transmitting unit can be in particular an LED that preferably radiates light in the visible and/or IR region. It is also conceivable to use another suitable optical transmitting unit, such as for example a laser diode. It is particularly preferable to use optical transmitting units that emit light in the wavelength range between 600 and 800 nm.

In an advantageous refinement of the invention, the dispenser can encompass at least one optical receiving unit. This makes it possible, for example, for the dispenser to receive signals from an optical transmitting unit arranged in the household appliance. This can be implemented by way of any suitable optical receiving unit, for example photocells, photomultipliers, semiconductor detectors, photodiodes, photoresistors, solar cells, phototransistors, CCD and/or CMOS image sensors. It is particularly preferred that the optical receiving unit be suitable for receiving light in the wavelength region from 600 to 800 nm.

The optical receiving unit on the dispenser can also, in particular, be embodied in such a way that the signals couplable into a cartridge coupled to the dispenser can be coupled out of the cartridge and are detectable by the optical receiving unit of the dispenser.

The signals emitted by the transmitting unit into the environment of the dispenser can preferably represent information items with regard to operating states or control instructions.

Dispenser Control Unit

In an advantageous refinement of the invention, data such, as, for example, control and/or dispensing programs of the dispenser control unit or operating parameters or protocols stored by the dispenser control unit can be read out of the dispenser control unit or loaded into the dispenser control unit. This can be implemented, for example, by means of an optical interface, the optical interface being connected correspondingly to the control unit. The data to be transferred are then encoded and emitted and/or received as light signals, in particular in the visible region, the wavelength range between 600 and 800 nm being preferred. It is also possible, however, to use a sensor present in the dispenser for transferring data from and/or to the control unit. For example, the contacts of a conductivity sensor, which are connected to the control unit and make available a conductivity determination by means of a resistance measurement at the contacts of the conductivity sensor, can be used for data transfer.

By means of the control unit it is possible in particular to embody a method for operating a dispenser, non-permanently connected to a household appliance, for delivering at least one washing- and/or cleaning-agent preparation into the interior of the household appliance, at least one dispensing program being stored in the control unit, and the control unit interacting with at least one actuator, located in the dispenser, in such a way that washing—and/or cleaning-agent preparation is releasable from the dispenser into the interior of the household appliance, the dispenser encompassing at least one receiving unit for signals that are emitted from at least one transmitting unit arranged in the household appliance, and at least a portion of the signals being converted, in the dispenser-side control unit, into control instructions for the actuators of the dispenser, dispenser-side reception of the signals being monitored by means of the control unit and, upon non-reception of the signals at the dispenser, a dispensing program from the control unit of the dispenser being activated.

It is thereby possible, in the event of a signal cutoff between the appliance-side transmitting unit and the dispenser, to ensure a dispensing of preparation by the fact that the dispenser transfers control authority from the household appliance to the control system internal to the dispenser.

It is advantageous in particular that the signal on the household-appliance side is emitted at predefined periodic time intervals from the transmitting unit on the household-appliance side into the interior of the household appliance. It is thereby possible for the defined periodic time intervals at which a signal is delivered from the household-appliance-side transmitting unit to be stored in the control unit of the dispenser and in the household appliance. If contact between the transmitting unit of the household appliance is cut off after reception of a signal at the dispenser, this cutoff can be ascertained at the dispenser end by a comparison between the time elapsed since the most recently received signal and the time within which, after the defined periodic time interval, reception of a subsequent signal is expected.

It is preferable that the periodic signal intervals be selected to be between 1 second and 10 minutes, preferably between 5 seconds and 7 minutes, particularly preferably between 10 seconds and 5 minutes. It is very particularly preferred that the periodic signal intervals be selected to be between 3 minutes and 5 minutes.

It is therefore particularly advantageous that reception of a signal delivered from the household appliance is logged in the control unit of the dispenser with a time information item $t_1$.

It is very particularly preferred that, after expiration of a predefined time interval $t_{1-2}$, beginning at $t_1$, in which no further signal from the household appliance has been received by the dispenser, the control unit of the dispenser activate a dispensing program from the control unit of the dispenser.

In an advantageous refinement of the invention, the signals emitted from the transmitting unit on the household-appliance side encompass at least one monitoring signal.

It is additionally advantageous that at least one dispensing program stored in the control unit encompasses a dispensing program of the household appliance. This enables the dispenser, in the event of a signal cutoff between the household appliance and the dispenser, to continue a dispensing program begun by the household appliance.

It is therefore particularly preferred that the dispensing programs stored in the control unit of the dispenser encompass the dispensing programs of the household appliance.

In the absence of a signal at the dispenser, in advantageous fashion an acoustic and/or optical signal, which is perceptible by a user and indicates the signal cutoff, can be generated.

It may further be advantageous that emission of a monitoring signal and/or control signal to the household appliance can be effected manually by a user. A user can thereby check, for example, whether, with the dispenser in a position selected by him or her within the household appliance, signal reception exists between the transmitting unit of the household appliance and the dispenser. This can be implemented, for example, by way of an operating element, for example a button or switch that is embodied on the household appliance and emits a monitoring and/or control signal upon actuation.

Dispenser Light Guide

An optical transmitting and/or receiving unit is preferably arranged inside the dispenser positionable in the interior of a dishwasher, in order to protect the electrical and/or optical components of the transmitting and/or receiving unit from the influence of water splashes and washing water.

In order to direct light from the environment of the dispenser to the optical transmitting and/or receiving unit, a light guide that has a light transmittance of at least 75% is arranged between the optical transmitting and/or receiving unit and the environment of the dispenser. The light guide is preferably made of a transparent plastic having a light transmittance of at least 75%. The transmittance of the light guide is defined as a transmittance between the surface of the light guide at which light is coupled from the environment of the dispenser into the light guide, and the surface at which light is coupled out of the light guide to the optical transmitting and/or receiving unit. The transmittance can be determined in accordance with DIN 5036.

Automatic Dishwasher

An automatic dishwasher suitable for the method according to the present invention comprises in particular a closable washing space. The washing space of an automatic dishwasher is usually opened and/or closed by means of a door or drawer. The washing space is usually thereby protected from the entry of ambient light.

An appliance-side receiving and/or transmitting unit for the light pulse signals is arranged in the interior and/or in the washing space of the automatic dishwasher. A receiving and/or transmitting unit of this kind is positioned at a suitable point in the interior and/or washing space and thus allows reliable reception of signals from the interior and/or washing space, and emission of signals into the interior and/or washing space of the automatic dishwasher. For example, the receiving and/or transmitting unit can be integrated into a combination dispenser of the automatic dishwasher. The further configuration of a receiving and/or transmitting unit of this kind is explained later on using the example of the combination dispenser. In principle, the configuration described there of the receiving and/or transmitting unit can also be implemented, independently of the combination dispenser, at another suitable point in the interior and/or in the washing space of the automatic dishwasher.

The walls of the washing space have in particular a degree of gloss of at least 10 gloss units, preferably at least 20 gloss units, particularly preferably at least 45 gloss units, measured according to DIN 67530 with a 60° geometry. This enables multiple reflections of the radiated optical signals at the walls of the washing space, thereby reducing the risk of possible signal shadows, in particular for optical signals in the visible and/or IR region, in the interior of the washing space of the automatic dishwasher.

"Average degree of gloss" means the degree of gloss averaged over the entire surface of a wall. In a particularly preferred embodiment of the invention, the average degree of gloss of the washing space walls is equal to at least 10 gloss units, preferably at least 20 gloss units, particularly preferably at least 45 gloss units, measured according to DIN 67530 with a 60° geometry.

"Average degree of washing space gloss" means the degree of gloss averaged over the entire surface of all washing space walls. In a further preferred refinement of the invention, the average degree of washing space gloss is equal to at least 10 gloss units, preferably at least 20 gloss units, particularly preferably at least 45 gloss units, measured according to DIN 67530 with a 60° geometry.

To reduce further the risk of signal shadows in the washing space, in particular for optical signals in the visible or IR range, it is particularly advantageous for the walls of the washing space to exhibit a reflectance of at least 50%.

"Average reflectance" means the reflectance averaged over the entire surface of a wall. In a particularly preferred development of the invention the average reflectance of the washing space walls is equal to at least 50%.

"Average washing space reflectance" means the reflectance averaged over the entire surface of all washing space walls. In a further preferred refinement of the invention, the average reflectance of the washing space walls is equal to at least 50%.

In a preferred embodiment of the invention, the walls of the washing space comprise optical reflection elements. The reflection elements serve for maximally homogeneous distribution of the optical signals, in particular in the visible and/or IR region, within the washing space, so that zones of optical signal shadows within the washing space are reduced or entirely avoided by the corresponding reflections. It is particularly preferred for the reflection elements to be shaped integrally with the washing space walls. According to an advantageous embodiment, the optical reflection elements project out of the plane of the washing space walls and into the washing space. It is also conceivable, however, for the optical reflection elements to be embodied as depressions in the washing space walls. The optical reflection elements may assume any suitable three-dimensional shape; in particular, the optical reflection elements are e.g. dome-shaped, bowl-shaped, frustoconical, cuboidal, cubic, having rounded or sharp edges and/or are shaped from combinations thereof.

The reflection elements can in particular be arranged approximately centered on a washing space wall. Additionally or alternatively, however, it is also conceivable to provide reflection elements at the edges or corners of a washing space wall in order to reduce the risk of signal shadows in particular in the rear, lower, and upper corners of the washing space (when viewed from the automatic dishwasher door).

Delivery Apparatus of the Dishwasher

In a preferred embodiment of the invention the dispenser can receive signals from a delivery apparatus fastened in an automatic dishwasher.

The delivery apparatus for delivering at least one preparation into the interior of a dishwasher can be, in particular, a cleaning agent releaser, a delivery device for rinse aid or salt, or a combination dispenser.

The delivery apparatus advantageously encompasses at least one transmitting unit and/or at least one receiving unit for wireless transmission of signals into the interior of the dishwasher and/or for wireless reception of signals from the interior of the dishwasher.

It is particularly preferred that the appliance-side transmitting unit and/or receiving unit be configured for the emission and/or reception of optical signals. It is very particularly preferred that the transmitting unit and/or receiving unit be configured for the emission and/or reception of light in the visible region. Because darkness usually prevails in the interior of the washing space during operation of an automatic dishwasher, signals in the visible optical region, for example in the form of signal pulses or light flashes, can be emitted and detected.

Alternatively or additionally, it is advantageous that the transmitting unit and/or receiving unit is configured for the emission and/or reception of infrared signals. It is advantageous in particular that the transmitting unit and/or receiving unit are configured for the emission and/or reception of infrared signals in the near infrared range (780 nm to 3000 nm).

In particular, the transmitting unit encompasses at least one LED. Particularly preferably, the transmitting unit encompasses at least two LEDs. It is very particularly advantageous in this context that at least two LEDs are arranged at an emission angle offset 90° from one another. It is thereby possible, as a result of the multiple reflections generated inside the dishwasher, to eliminate the risk of signal shadows in which a freely positionable receiver of the signals, in particular a dispenser, might be located.

It is also possible, according to a further preferable embodiment of the invention, to provide at least two LEDs that emit light at wavelengths differing from one another. This makes it possible, for example, to define different signal bands on which information items can be sent and/or received.

It is further advantageous, in a refinement of the invention, for at least one LED to be an RGB LED whose wavelength is adjustable. It is thus possible, for example, to define with one LED a variety of signal bands that emit signals at different wavelengths. It thus also conceivable, for example, for light to be emitted during the drying operation, during which high humidity (mist) is present in the washing space, at a different wavelength than, for example, during a washing step.

The transmitting unit of the delivery apparatus can be configured so that the LED is provided both for the emission of signals into the interior of the dishwasher, in particular when the automatic dishwasher door is closed, and for optical indication of an operating state, for example the fill level of the reservoir container for salt or rinse aid of an automatic dishwasher, in particular when the dishwasher door is open.

It is particularly preferred that an optical signal be embodied as a signal pulse or a sequence of signal pulses.

It is further advantageous that the transmitting unit is configured in such a way that it emits an optical signal, when the automatic dishwasher is closed, that produces an average illumination intensity E of between 0.01 and 100 lux, preferably between 0.1 and 50 lux, measured at the walls delimiting the washing space. This illumination intensity is then sufficient to produce multiple reflections with and/or at other washing space walls, thereby reducing and/or preventing possible signal shadows in the washing space, especially when the automatic dishwasher is in the loaded state.

The receiving unit of the delivery apparatus can encompass, in particular, a photodiode.

In a refinement of the invention, the delivery apparatus can also, additionally or alternatively, is configured for the emission and/or reception of radio signals.

The signal emitted from the transmitting unit and/or received by the receiving unit is, in particular, a carrier of information, in particular a control signal.

It is particularly preferred that the delivery apparatus be arranged in the door of an automatic dishwasher.

A receptacle for detachable fastening of a dispenser on the delivery apparatus can furthermore be provided on the delivery apparatus. This makes it possible, for example, to position the dispenser not only in the tableware rack of a dishwasher, but also directly on a delivery apparatus of the dishwasher, in particular a combination dispenser. On the one hand this means that no loading space in the tableware rack is occupied by the dispenser; on the other hand, defined positioning of the dispenser relative to the delivery apparatus is achieved.

It is furthermore advantageous to configure the delivery apparatus fastening system and the transmitting and/or receiving unit in such a way that at least the transmitting unit radiates directly onto the receiver of the dispenser arranged in the fastening system.

Advantageously, the dispenser non-permanently connected to the dishwasher, for use in a dispensing system encompassing the delivery apparatus, comprises at least one receiving unit and/or at least one transmitting unit for wireless transmission of signals out of the interior of the dishwasher to the delivery apparatus, and/or for wireless reception of signals from the delivery apparatus.

The light guide comprises at least one in-coupling and/or out-coupling point at which light from an optical transmitting and/or receiving unit and/or from the environment of the dispenser is in-coupled and/or out-coupled.

It is particularly preferred that the light guide be embodied integrally with the component carrier. Advantageously, the component carrier is therefore made from a transparent material.

An opening is provided in the dispenser in order to receive the in-coupling and/or out-coupling point of the light guide and to create an optical connection between the light guide and the environment. The in-coupling and/or out-coupling point can be arranged in the enveloping surface, or in the bottom or top of the dispenser. In order to make available a good transmitting and/or receiving characteristic for optical signals, it may be advantageous for the in-coupling and/or out-coupling point of the light guide to be of lenticular and/or prismatic construction.

The light guide can also be constructed in multi-layer and/or multi-part fashion, from identical or different materials. It is also possible to provide an air gap between a light guide of multi-layer and/or multi-part conformation. The transmittance of the light guide is understood in the case of multi-layer and/or multi-part structure as being between the surface of the light guide at which light is in-coupled from the environment of the dispenser into the light guide, and the surface at which light is out-coupled from the light guide to the optical transmitting and/or receiving unit.

In addition, it is preferable for at least two in-coupling and/or out-coupling points of the light guide with the environment to be provided. It is particularly advantageous for the in-coupling and/or out-coupling points to be located substantially opposite one another on the dispenser.

Referring now to FIG. 1, the lower portion of FIG. 1 depicts the signal curve over time at a receiving unit positioned in the interior of an automatic dishwasher. The receiving unit is made up of at least one photodiode that is suitable for detecting light pulses in the visible region. At point in time (1), the receiving unit receives a light pulse $I_1$ that has a fixed and predefined pulse duration $l_{t1}$. The light pulse $I_1$ ends at point in time (2). The light pulse is delivered by a transmitting unit into the interior of the automatic dishwasher, the transmitting unit encompassing an LED that radiates light in the visible region. As may further be easily gathered from FIG. 1, a light pulse always has the same duration $l_{t1}$.

Reception of the light pulse $I_1$ causes a time measurement to be started. This will be discussed in further detail later on.

Immediately before reception of the light pulse, the receiver is set to a high sensitivity so that the emitted light pulse can be received effectively. This is shown in the upper portion of FIG. 1, where the sensitivity of the receiving unit is plotted parallel to the time and/or signal curve. It is evident that at point in time (1), the sensitivity is set to a high sensitivity.

After reception of the light pulse $I_1$ at point in time (2), the output signal of the receiving unit at first rises slowly toward the idle level because the sensitivity of the receiving unit is still high. The result of switching over the receiving unit, after reception of the light pulse $I_1$, from a high to a low sensitivity at point in time (3) is that the output signal of the receiving unit rises more quickly back to the idle level. The low-sensitivity duration is selected so that the output signal of the receiving unit reliably returns back to the idle level. In this fixed transmission off-time, whose duration $t_p$ is located between points in time (2) and (4), no light pulses are emitted into the interior of the automatic dishwasher.

At point in time (4), i.e. after the fixed transmission off-time $t_p$, the sensitivity of the receiving unit is switched back to high sensitivity.

The duration $t_v$ between points in time (4) and (5) is variable, as indicated inter alia by the interrupted dimensioning line. One or more information items can be encoded by means of the variable off-time, in which once again no light pulses are emitted. The duration of the variable off-time thus contains the information to be transferred.

The second light pulse $I_2$ of the transmitting unit, which pulse the receiving unit can effectively detect because the sensitivity is again high, starts after the variable off-time $t_v$. At this point in time (5), the time measurement begun at point in time (1) ends, and the time difference between reception of the first light pulse $I_1$ and of the second light pulse $I_2$ is determined.

Because the fixed pulse duration $l_{t1}$ of the first light pulse $I_1$, and the fixed off-time $t_p$ subsequent in time thereto in which no light pulses are emitted, are known, the transferred information can be coded and/or decoded from the time difference $t_{I2}-t_{I1}$.

Figure 2:
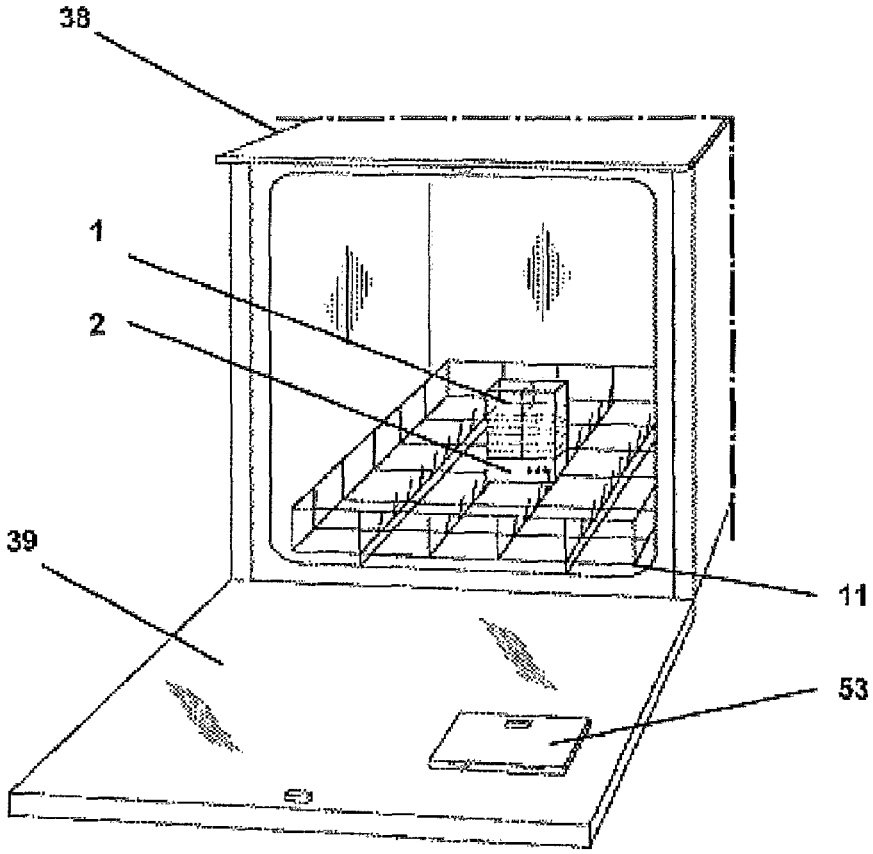
FIG. 2 illustrates a dispenser having a two-chamber cartridge, arranged in a rack of an automatic dishwasher.

FIG. 2 shows an autonomous dispenser having a two-chamber cartridge 1 in tableware rack 11, the automatic dishwasher door 39 of an automatic dishwasher 38 being open. It is evident that dispenser 2 having cartridge 1 is positionable in principle at any point within tableware rack 11, it being advantageous to provide a plate- or cup-shaped dispensing system 1, 2 in a corresponding plate or cup receptacle of tableware rack 11. Located in automatic dishwasher door 39 is a dispensing chamber 53 into which an automatic dishwasher cleaner preparation can be introduced, for example in the form of a tablet. When dispensing system 1, 2 is in the operational state in the interior of dishwasher 38, it is therefore unnecessary to add cleaning preparation for each washing cycle via dispensing chamber 53, since cleaning agent delivery is implemented via dispensing system 1, 2 for a plurality of washing cycles. An advantage of this embodiment of the invention is that when the autonomous dispensing system 1, 2 is arranged in the lower dishwasher rack 11, preparations 40*a*, 40*b* are delivered out of cartridge 1 into the washing bath directly via the outlet openings arranged at the bottom of the dispenser, so that quick dissolution and uniform distribution of the washing preparations in the washing program is ensured.

Dispenser 2 possesses an optical transmitting and receiving unit, in the form of an LED and a photodiode that are embodied to emit and/or receive light in the visible region. An optical transmitting and receiving unit in the form of an LED and a photodiode which are embodied to emit and/or receive light in the visible region is also embodied in dispensing chamber 53, so that when automatic dishwasher door 39 is closed, information items can be transferred between automatic dishwasher 38 and dispenser 2 by way of the above-described optical method.

Figure 3:
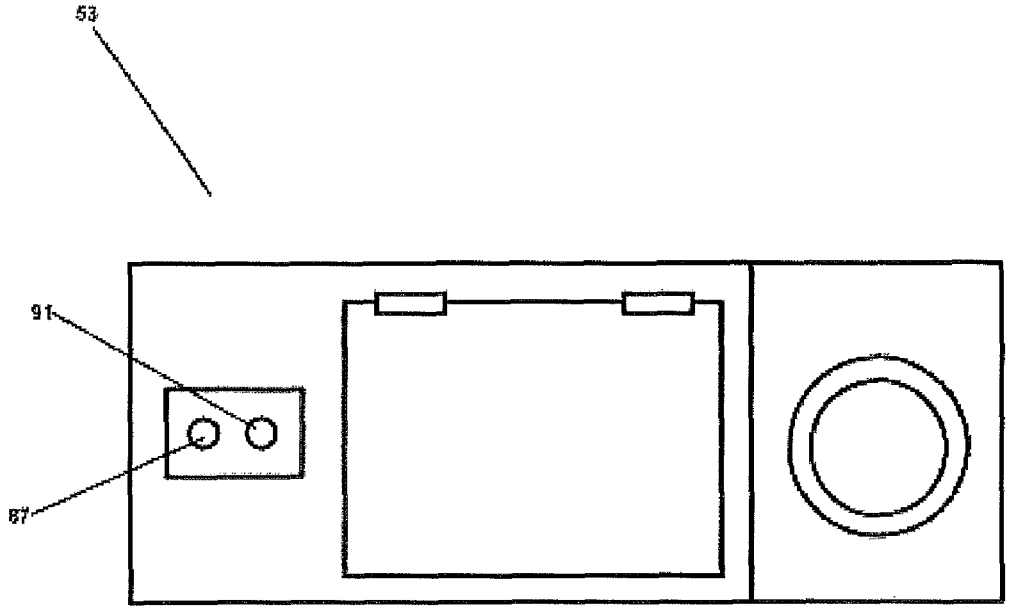
FIG. 3 illustrates a combination dispenser having a transmitting and receiving unit.
Figure 4:
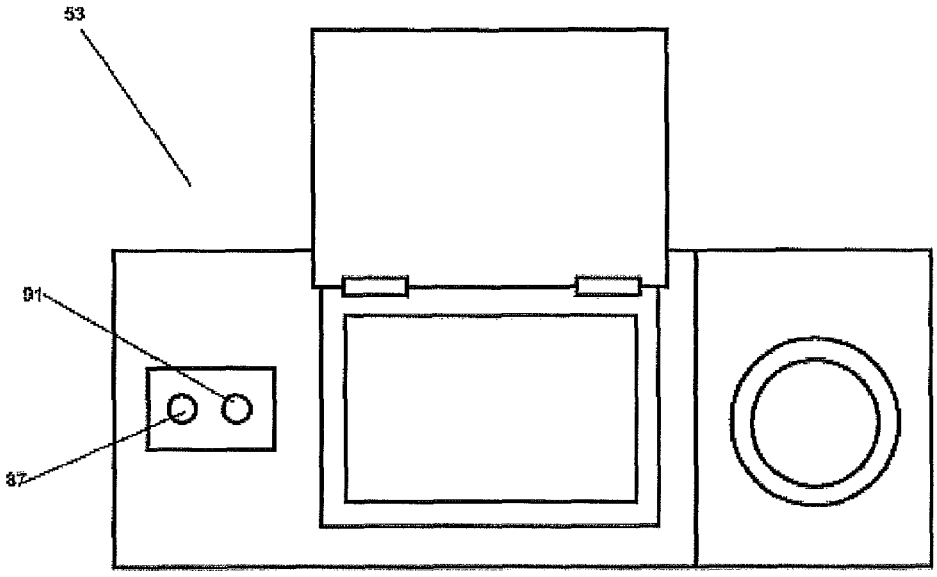
FIG. 4 illustrates a combination dispenser having a transmitting and receiving unit, with dispensing chamber cover opened.

FIG. 3 shows a dispensing chamber 53 into which a transmitting unit 87 and a receiving unit 91 are integrated. A dispensing chamber 53 of this kind is also known as a combination dispenser. Dispensing chamber 53 comprises a receptacle, closable by an articulated closure cover, for a dishwashing agent. FIG. 4 shows the closure cover in its open position. In addition, dispensing chamber 53 can also comprise a receptacle for a rinse aid, which is indicated by the circular closure to the right of the closure cover in FIGS. 3 and 4.

Transmitting unit 87 encompasses a light-emitting means that is arranged in transmitting unit 87 in such a way that the light-emitting means radiates into the interior of the automatic dishwasher. The light-emitting means can be, in particular, an LED or a laser diode. The LED is arranged so that it projects out of the plane of transmitting unit 87, so that the LED produces the largest possible emission angle.

Transmitting unit 87 can be configured so that the LED is provided both for the emission of signals into the interior of dishwasher 38, in particular when automatic dishwasher door 39 is closed, and for optical indication of an operating state, for example the fill level of the reservoir container for salt or rinse aid of an automatic dishwasher, in particular when automatic dishwasher door 39 is open.

Receiving unit 91 is preferably made up of a photodiode that is suitable for detecting light signals from the interior of the automatic dishwasher. Like transmitting unit 87, the photodiode of receiving unit 91 can also project out of the plane of the receiving unit in order to achieve a maximally optimum radiation characteristic onto the photodiode.

The manner in which transmitting unit 87 interacts with a dispenser 2 arranged in the interior of an automatic dishwasher 38, in particular in a tableware rack, is described in further detail below with reference to FIGS. 5 to 8.

Figure 5:
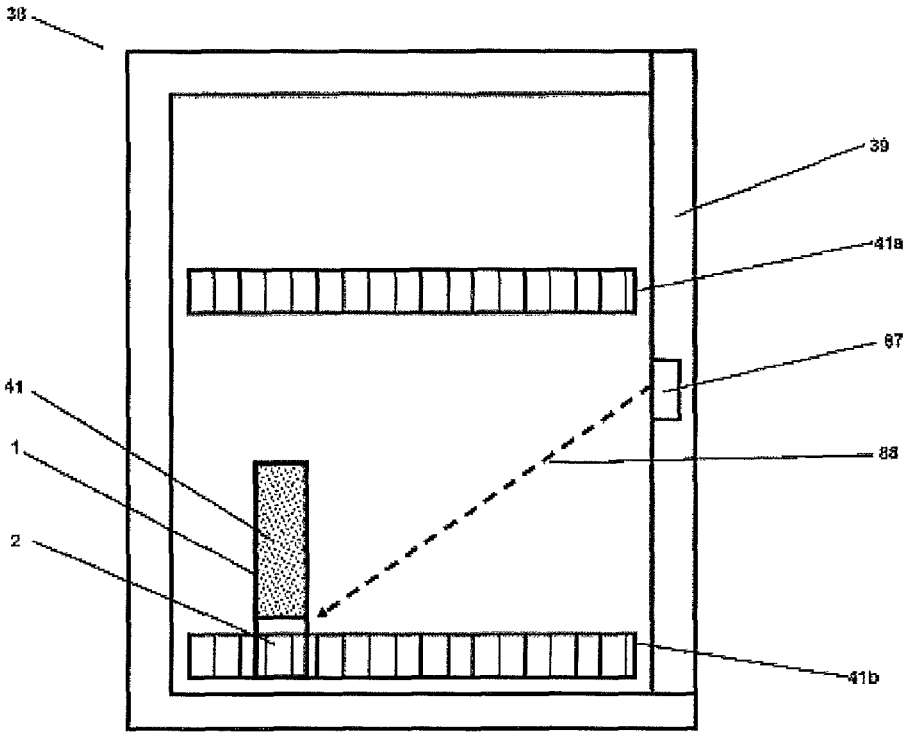
FIG. 5 illustrates a dispenser and transmitting device arranged in household appliance.

FIG. 5 will be discussed first. It shows an automatic dishwasher 38 in a schematic cross-sectional view. Located in the interior of automatic dishwasher 38, arranged one above another, are two tableware racks 41*a*, 41*b* for receiving items to be washed such as, for example, plates, cups, etc. Automatic dishwasher 38 possesses a pivotable door 39 that is shown in FIG. 5 in the closed state. Integrated into automatic dishwasher door 39 is a transmitting unit 87 that is coupled to the control system of automatic dishwasher 38. Transmitting unit 87 is preferably integrated into a combination dispenser 53 in accordance with FIGS. 3 to 4.

Transmitting unit 87 encompasses an LED that emits an optical signal 88, which is a carrier of a control information item, into the interior of automatic dishwasher 38. This signal, and its direction, is indicated by the arrow in FIG. 5. The dashed line of the arrow indicates that optical signals 88 emitted from transmitting unit 87 are light flashes and/or light pulses.

Dispenser 2, having a cartridge 1, is positioned in lower tableware rack 41*b*. It is of course possible to arrange dispenser 2 with cartridge 1 at any suitable point in the lower or upper tableware rack 41, plate receptacles provided in or on tableware rack 41 being preferable for the placement of dispenser 2.

Dispenser 2 possesses a receiving unit 91 that is not depicted in FIG. 5. Optical signals 88 emitted from transmitting unit 87 are received by receiving unit 91 of dispenser 2, and are evaluated and/or converted by the control unit of dispenser 2.

An optical signal 88 can be emitted from transmitting unit 87 in particular at the beginning of a washing program, which signal, after being received by dispenser 2, causes control of dispenser 2, in particular control of dispensing times and quantities, to be transferred to the control system of automatic dishwasher 38. This is advantageous in particular if the control system of dispenser 2 has its own dispensing programs for operation independently of automatic dishwasher 38, but they are not to be executed upon detection of a corresponding signal 88 of a transmitting unit 87 that is present.

Figure 6:
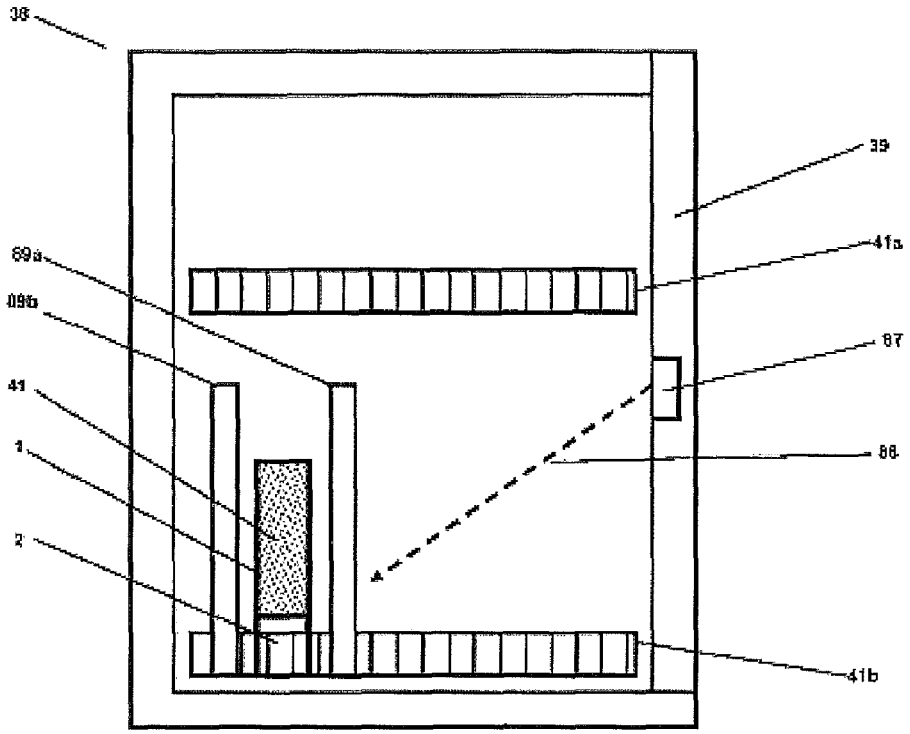
FIG. 6 illustrates a dispenser and transmitting device arranged in household appliance with household appliance loaded.

FIG. 6 depicts a situation in which dispenser 2 cannot receive signals from transmitting unit 87 because, for example, dispenser 2 in tableware rack 41*b* is surrounded by items to be washed (objects) 89*a*, 89*b* in such a way that reception of signals 88 from and to transmitting unit 87 is prevented. This can also occur, for example, because items being washed tip over in the course of a dishwashing program.

In this instance of non-reception or cutoff of signals 88 at dispenser 2, a dispensing program from the control unit of dispenser 2 is activated so that dispenser 2, independently of the control system of automatic dishwasher 38, will dispense at least one preparation 40 during a washing program. This prevents a situation in which, because of a signal cutoff, preparation 40 is not delivered into the interior of automatic dishwasher 38 during a washing program, thereby producing poor cleaning performance. This applies to situations both at the start of a washing program and during a washing program.

In order to detect a signal cutoff between dispenser 2 and transmitting unit 87, an additional monitoring signal 90 can be provided which is emitted by transmitting unit 87 at predefined fixed time intervals, while control signal 88 is emitted at fixed time intervals or only upon immediate transmission of a control signal. This is sketched by way of example in FIG. 7. Because transmitting unit 87 is usually operated by way of the power supply line of automatic dishwasher 38, emission of a periodic monitoring signal 90 does not represent an unacceptable load on the energy source of dispenser 2, since monitoring signals 90 simply need to be received and evaluated during a washing program.

Figure 8:
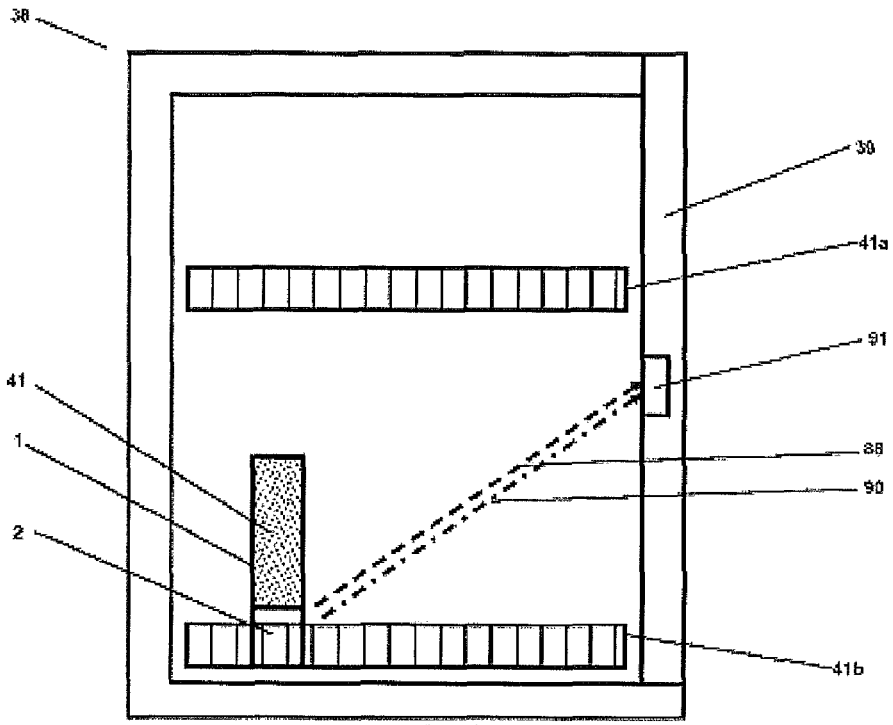
FIG. 8 illustrates a dispenser having transmitting device delivering two signal types, and receiving device in household appliance.

As shown in FIG. 8, it is of course also conceivable, if the energy source of dispenser 2 is dimensioned adequately, for both monitoring signals 90 and control signal 88 to be transmitted from dispenser 2 to a corresponding receiving unit 91 in automatic dishwasher 38.

Figure 7:
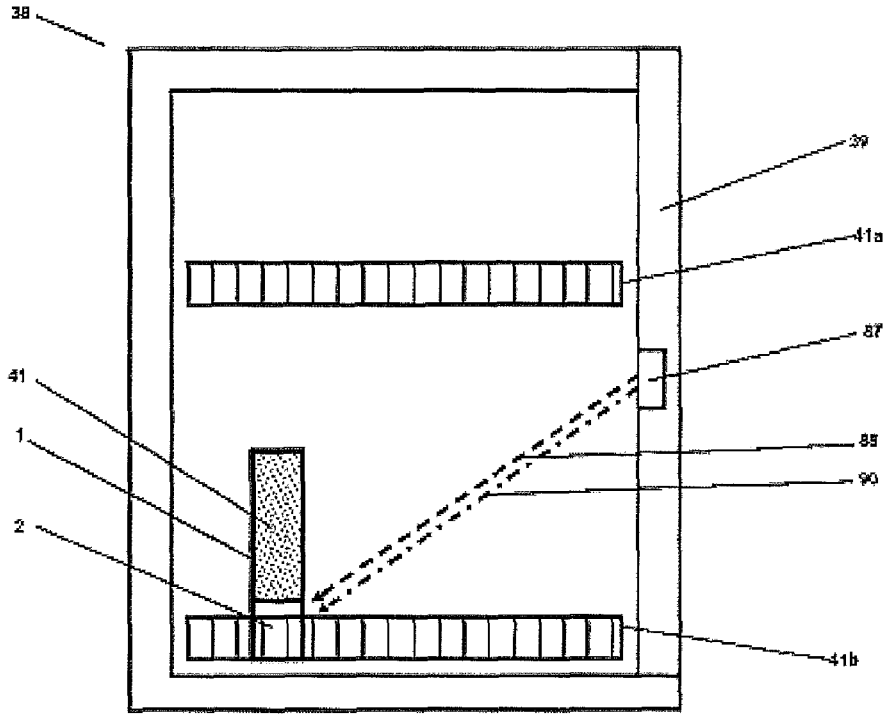
FIG. 7 illustrates a dispenser and transmitting device arranged in household appliance and delivering two signal types.

It is also possible in principle for the transmitting and receiving modes of control and monitoring signals 88, 90 according to FIG. 7 and FIG. 8 to be superimposed and/or to proceed in parallel. In other words, a monitoring signal 90 is emitted by transmitting unit 87 and received by dispensing unit 2, and control signal 88 is transmitted by the dispensing unit to a receiving unit 91.

Figure 9:
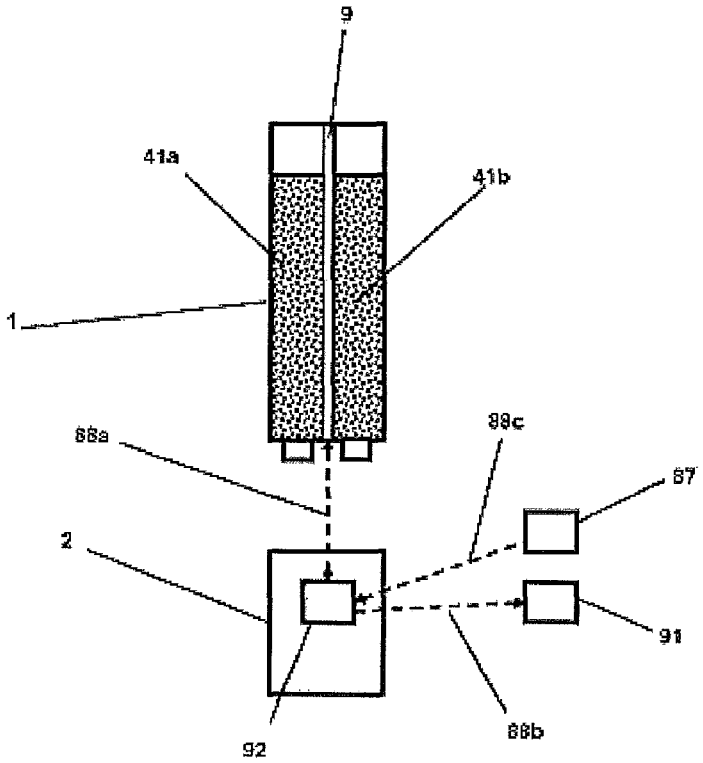
FIG. 9 illustrates a dispenser having optical transmitting device, couplable cartridge, and household-appliance-side transmitting and/or receiving devices.

A further embodiment of the invention is illustrated in FIG. 9, which shows dispenser 2 that possesses an optical transmitting and receiving unit 111. By means of optical transmitting and receiving unit 111, control signals 88*b* can be transmitted to a dishwasher-side receiving unit 91, and control signals 88*c* can be received from a dishwasher-side transmitting unit 87. The dishwasher-side receiving unit 91 and dishwasher-side transmitting unit 87 are preferably arranged in a combination dispenser such as the one shown in FIGS. 3 to 4. Furthermore, optical signals 88*a* can be coupled from optical transmitting and receiving unit 111 into cartridge 1, in particular into strut 9 embodied as a light guide, and/or coupled out of cartridge 1 and received by optical transmitting and receiving unit 111.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We claim:

1. A method for controlling a dispenser apparatus reversibly positioned in the interior of a dishwasher, said method comprising the steps of:

a. providing a light transmitting unit as part of said dispenser or as part of said dishwasher, said transmitting unit capable of emitting light pulses;

b. providing a light receiving unit as part of said dispenser or as part of said dishwasher, said receiving unit capable of receiving light pulses;

c. emitting a first light pulse $I_1$ from said transmitting unit into the interior of said dishwasher, said pulse having a predefined pulse duration of $l_{t1}$;

d. receiving said first light pulse $I_1$ by said receiving unit, said reception initiating a time lapse measurement beginning at time $t_{I1}$;

e. emitting a second light pulse $I_2$ from said transmitting unit into the interior of said dishwasher, said pulse having a predefined pulse duration of $l_{t2}$;

f. receiving said second light pulse $I_2$ by said receiving unit, said reception terminating said time lapse measurement at time $t_{I2}$;

g. calculating the time difference $t_{I2}-t_{I1}$; and h. encoding an information item or the portion of an information item based on said time difference.

2. The method according to claim 1, wherein said information item is selected from the group consisting of a control signal, a measured value, an operating state of the dishwasher, an operating state of the dispensing apparatus, and mixtures thereof.

3. The method according to claim 1, further including the steps of a predefined fixed transmission off-time $t_p$ following said predefined pulse duration $l_{t1}$, and a variable transmission off-time $t_v$ following said predefined fixed transmission off-time, wherein said variable transmission off-time $t_v$ encodes said information item or said portion of said information item.

4. The method according to claim 3, wherein said predefined fixed transmission off-time $t_p$ is between 1 and 100 ms.

5. The method according to claim 3, wherein said predefined fixed transmission off-time $t_p$ is between 10 and 25 ms.

6. The method according to claim 3, wherein said predefined fixed off-time $t_p$ corresponds approximately to the said pulse duration $l_{t1}$.

7. The method according to claim 3, wherein said variable transmission off-time $t_v$ is between 1 and 1,000 ms.

8. The method according to claim 3, wherein said variable transmission off-time $t_v$ is between 10 and 250 ms.

9. The method according to claim 1, wherein said first and second light pulses have wavelengths between 380 and 780 nm.

10. The method according to claim 1, wherein said first and second light pulses have wavelengths from 780 to 3,000 nm, from 3.0 to 50 μm, or from 50 μm to 1 mm.

11. The method according to claim 1, wherein said pulse duration $l_{t1}$ is between 1 and 100 ms.

12. The method according to claim 1, wherein said pulse duration $l_{t1}$ is between 10 and 25 ms.

13. The method according to claim 1, wherein said information item or said portion of said information item is encoded from a sequence of light pulses.

14. The method according to claim 1, wherein said light pulses are modulated such that intrinsic signal detection is enabled.

15. The method according to claim 1, wherein said receiving unit comprises variable sensitivity.

16. The method according to claim 1, wherein said receiving unit comprises variable sensitivity adjustable between high and low sensitivity.

17. The method according to claim 16, wherein said receiving unit is set to high sensitivity upon reception of a light pulse.

18. The method according to claim 16, wherein said receiving unit is set to low sensitivity immediately after the duration $l_{t1}$ of said first light pulse.

19. The method according to claim 1, wherein said receiving unit comprises variable sensitivity adjustable between high and low sensitivity.

20. The method according to claim 19, wherein said receiving unit is set to high sensitivity immediately after said predefined transmission off-time $t_p$.

* * * * *